US007614090B2

(12) United States Patent
Kronenberger

(10) Patent No.: US 7,614,090 B2
(45) Date of Patent: Nov. 10, 2009

(54) HEADWEAR PIECE WITH ADJUSTABLE HEAD RECEIVING DIAMETER

(75) Inventor: Ronald Kronenberger, Riverwoods, IL (US)

(73) Assignee: American Needle, Buffalo Grove, IL (US)

( * ) Notice: Subject to any disclaimer, the term of this patent is extended or adjusted under 35 U.S.C. 154(b) by 895 days.

(21) Appl. No.: 11/102,388

(22) Filed: Apr. 8, 2005

(65) Prior Publication Data

US 2006/0225185 A1 Oct. 12, 2006

(51) Int. Cl.
*A42B 1/22* (2006.01)

(52) U.S. Cl. ..... 2/195.2; 2/209.13; 2/209.14; D2/874

(58) Field of Classification Search ..... 2/410, 2/195.8, 195.1, 209.4, 209.13, 209.14, 209.12; D2/866, 874, 880, 881, 884, 893, 891, 894, D2/895

See application file for complete search history.

(56) References Cited

U.S. PATENT DOCUMENTS 1,837,695 A * 12/1931 Werner ..... 2/195.2
2,192,341 A * 3/1940 Dahlberg ..... 2/203
D134,581 S * 12/1942 Karlen ..... D2/894
4,036,101 A * 7/1977 Burnett ..... 87/8
D270,300 S * 8/1983 Jarvis ..... D2/894
6,094,749 A * 8/2000 Proctor ..... 2/195.2
2003/0106127 A1* 6/2003 Shwartz et al. ..... 2/12

* cited by examiner

*Primary Examiner*—Gary L Welch
*Assistant Examiner*—Alissa J Tompkins
(74) *Attorney, Agent, or Firm*—Wood, Phillips, Katz, Clark & Mortimer

(57) ABSTRACT

A headwear piece has a crown defining a surface for engaging a wearer's head and a rim projecting away from the crown. The crown surface has a variable effective diameter. The crown has a rope defined by a plurality of elongate elements each having an actual length and interconnected with each other with the rope in a first state so as to define a shorter effective length extending around at least a portion of the crown. The plurality of elongate elements are extendable by exerting a tensile lengthwise force on the rope to place the rope in a second state. The rope at least one of (a) defines at least a part of the crown surface and (b) bears against a wall that defines at least a part of the crown surface.

42 Claims, 9 Drawing Sheets

FIG. 1
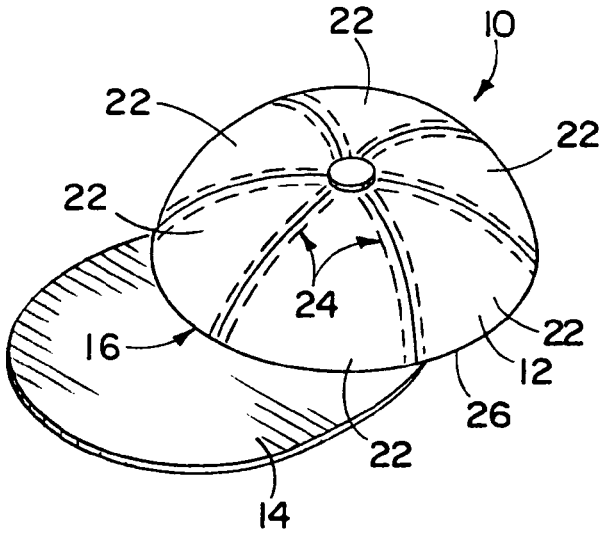
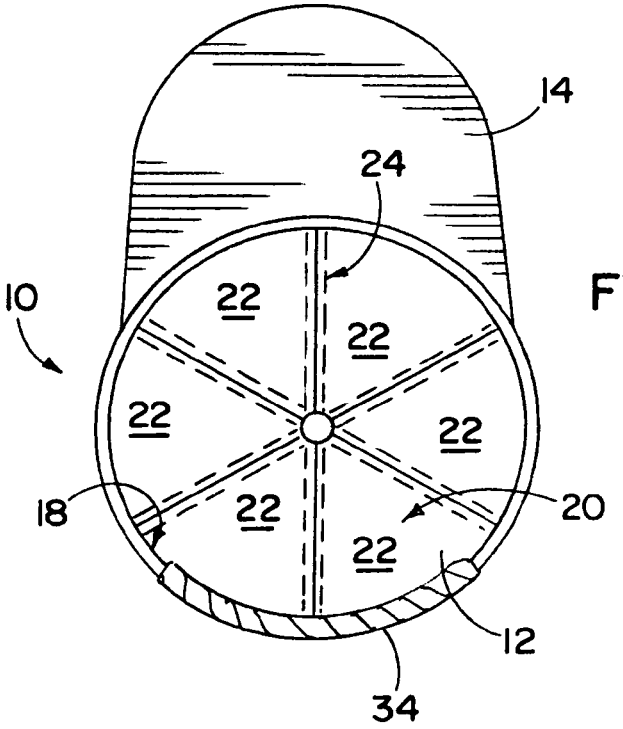
FIG. 2
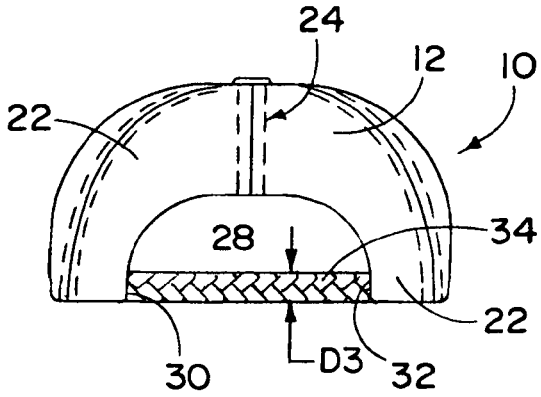
FIG. 3

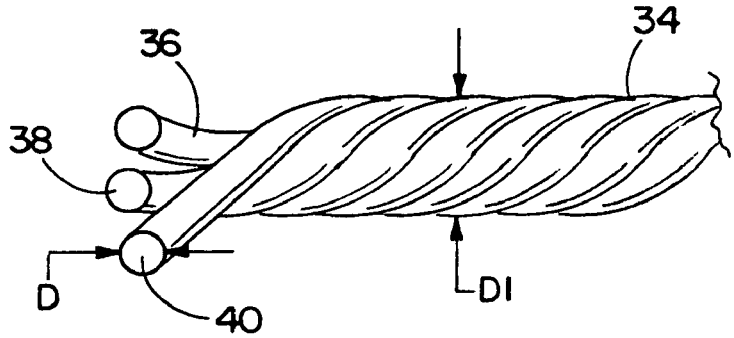
FIG. 4
FIG. 5
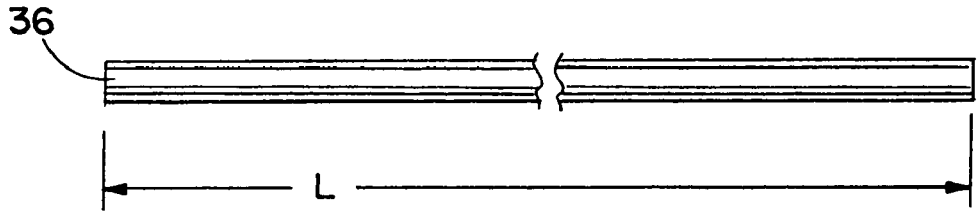
FIG. 6
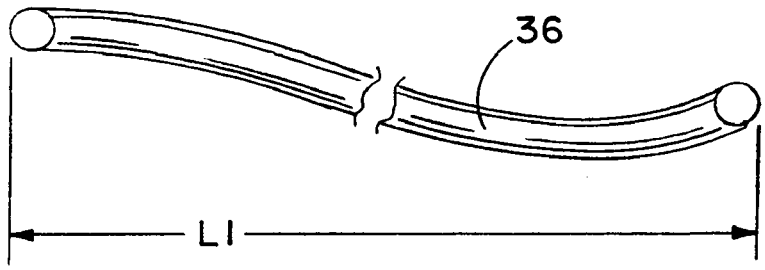
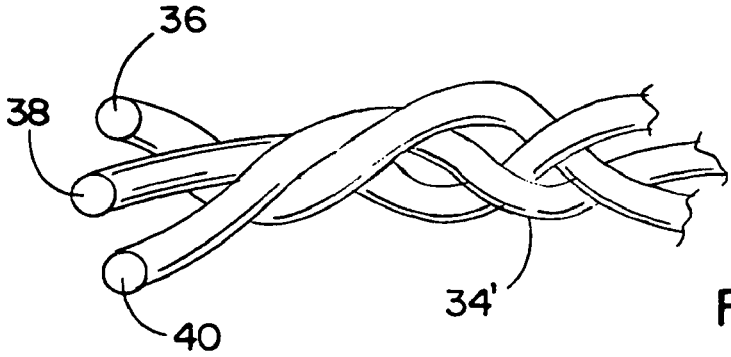
FIG. 7

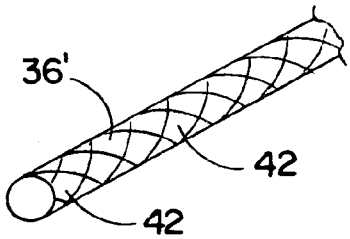
FIG. 8
FIG. 9
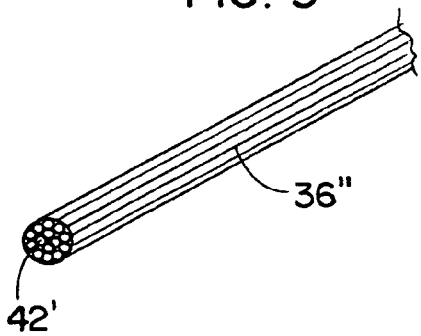
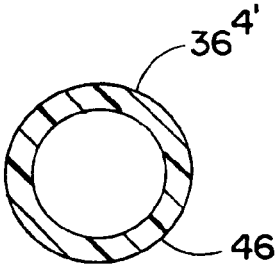
FIG. 11
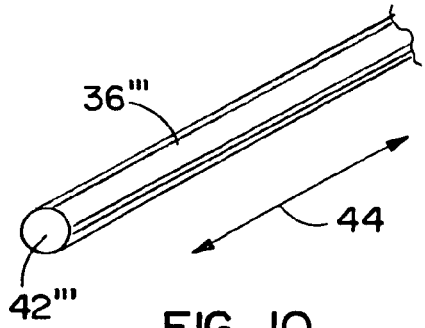
FIG. 10
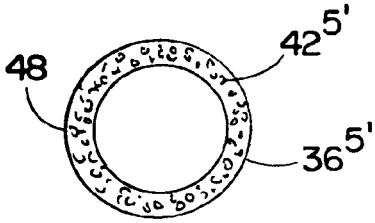
FIG. 12
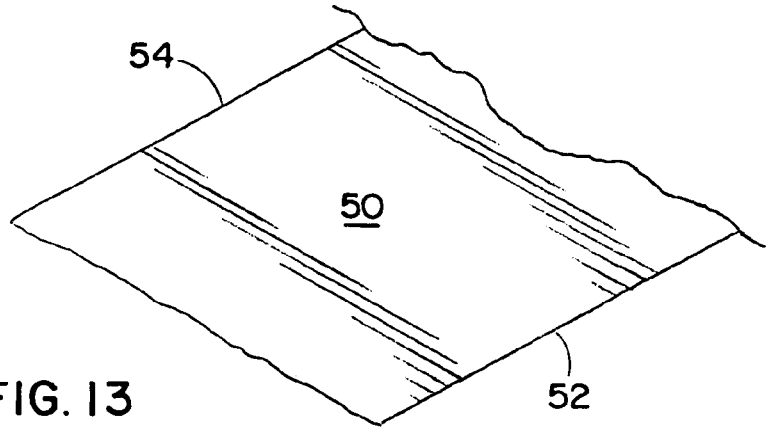
FIG. 13

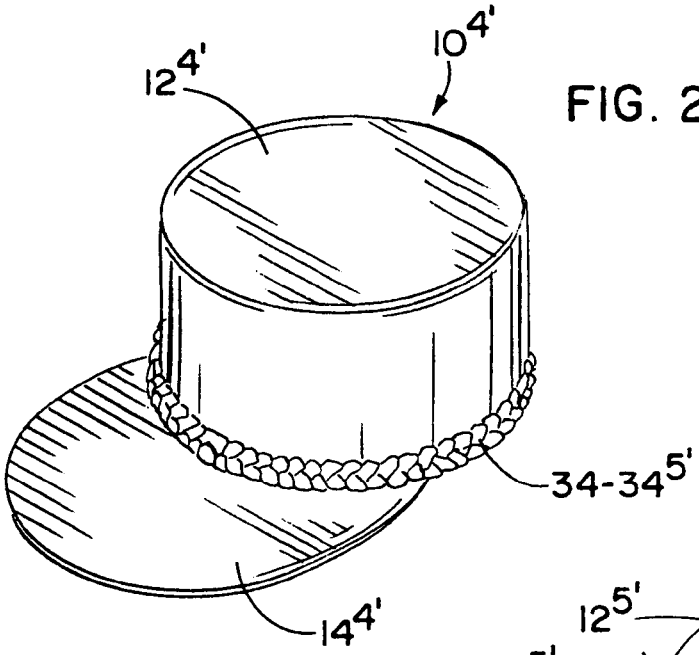
FIG. 23
FIG. 24
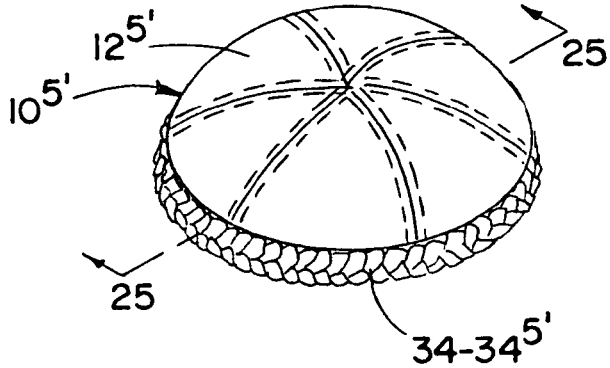
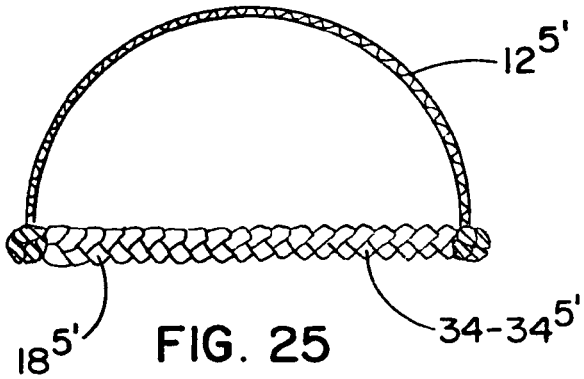
FIG. 25
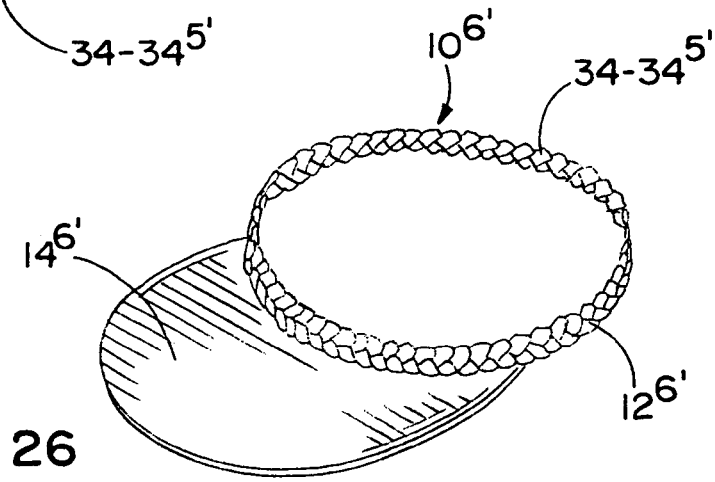
FIG. 26

HEADWEAR PIECE WITH ADJUSTABLE HEAD RECEIVING DIAMETER

BACKGROUND OF THE INVENTION

1. Field of the Invention

This invention relates to headwear and, more particularly, to a headwear piece with a surface engageable with a wearer's head and having a variable effective diameter.

2. Background Art

The headwear industry is driven by the goal of designing new products that are more comfortable and aesthetically pleasing. The goal of comfort is particularly important for headwear that is worn on a regular basis during participation in activities, such as baseball-style caps worn while playing baseball/softball, visors worn while playing golf, etc.

Visors have become increasingly popular due to their versatility. The forwardly projecting rim/bill on the visor affords the user frontal protection against the sun, rain, etc. At the same time, the open top of the crown leaves the top of the user's head exposed, which is desirable particularly when the visor is worn in pleasant weather conditions.

Many different structures have been devised to maintain the visor in an operative position on the wearer's head. In the most common construction, a continuous surface on the crown is caused to engage the wearer's head. In one form, an adjustable strap is integrated at the rear of the visor. By reconfiguring the strap, the user can select an appropriate diameter, within an afforded range, that is most comfortable. Generally, with this design, only a modicum of change in the effective diameter is permitted from the selected diameter. As a result, the initial fitting is often carried out on a trial-and-error basis. That is, the user will select a desired diameter, try the visor on for feel, and then remove the same to make further adjustments. It is common to witness wearers of this type of visor repeatedly making adjustments even after an initial size was selected with the belief that it represented the optimal fit. Further adjustments may also be necessitated in the event that the state of the user's hair changes, as in high humidity or rainy conditions, or in the event that the user rearranges his or her hair.

It is also common with this type of adjusting mechanism to employ a hook and loop fastener that allows selective interconnection of strap parts. While this structure is generally convenient, there is a tendency of the user's hair to become entangled in the fastening material.

Other types of adjusting structure include snaps, D clips, etc. With most of these structures, one contends with the problem that the limited "give" in the engaging surface makes it difficult to find an optimal diameter that produces a comfortable feel. If the fit is too tight, the visor causes discomfort. If it is too loose, the visor tends to shift on the wearer's head. The user may find that by reason of the relatively small vertical dimension of the crown surface, the diameter that is selected for best feel may not effectively maintain the visor in place on the wearer's head. This problem may be alleviated to a certain extent by existing fabrics that are capable of stretching within a limited range of size adjustment.

Another popular visor design has a crown with a U-shaped, clip configuration. The base of the "U" supports the rim/bill. Spaced legs project away from the base and grippingly engage the wearer's head at the sides thereof immediately above the ear region. This design is desirable particularly for those with relatively long hair. The legs can be conveniently passed through the hair at the sides of the wearer's head, rather than fully over the hair.

The problem with the above, "clip-type", visor is that a good balance between comfort and holding force may be difficult to achieve. The holding force is established primarily by reason of the user's head being squeezed between the legs. As a result, there is a relatively concentrated holding force applied by the legs, which tends to dig into the user's head. The user's head may thus be uncomfortably pinched. A reduction in pressure may cause the visor to slip undesirably. This type of visor is commonly used by women during the playing of golf. Consequently, it is important that the visor stay in place during this activity but also that it be comfortable for the wearer.

While the above design issues and problems are commonly faced by those designing what might be considered active headwear, such as baseball caps and visors, these problems are also experienced with virtually any type of headwear styles, including even formal headwear. The industry actively continues to pursue new designs with the above-noted objectives in mind.

SUMMARY OF THE INVENTION

In one form, the invention is directed to a headwear piece having a crown defining a surface for engaging a wearer's head, so as to maintain the headwear piece in an operative position on the wearer's head, and a rim projecting away from the crown. The crown surface has a variable effective diameter. The crown has a rope defined by a plurality of elongate elements each having an actual length and interconnected with each other with the rope in a first state so as to define an effective length extending around at least a portion of the crown. The plurality of elongate elements are elastically maintained at the effective lengths at least partially by reason of their interconnection with each other and are extendable towards their actual lengths by exerting a tensile lengthwise force on the rope to place the rope in a second state. The rope at least one of (a) defines at least a part of the crown surface and (b) bears against a wall that defines at least a part of the crown surface. The effective diameter of the crown surface is greater with the rope in the second state than with the rope in the first state.

In one form, the crown surface extends continuously through 360° around an opening to receive a wearer's head.

At least one of the elongate elements may be made from elastic material.

The plurality of elongate elements may be interconnected by wrapping one of the elongate elements around another of the elongate elements.

The plurality of elongate elements may be interconnected by at least one of: twisting; braiding; weaving; knitting; and knotting, or by other processes.

In one form, with the rope in the first state, at least one of the elongate elements has an effective diameter on the order of at least 1/16 inch.

In another form, this diameter is at least 1/8 inch.

In another form, this diameter is at least 1/8 inch.

In a further form, this diameter is at least 1/4 inch.

In one form, the headwear piece has an identification thereon associated with a person, place, or thing, with which first and second colors are commonly associated. One of the elongate elements includes the first color and another of the elongate elements includes the second color.

In one form, the rope is made from at least four interconnected, elongate elements.

In one form, the rope has first and second elongate elements with different appearances interconnected to produce a pattern in which the first and second different appearances are exposed.

The first and second different appearances may be different colors associated with a person, place, or thing.

In one form, the crown has an open top through which a wearer's head projects with the headwear piece in the operative position on the wearer's head.

The crown may have an inverted cup-shaped configuration.

In one form, the rim extends only partially around a wearer's head with the headwear piece in the operative position on the wearer's head.

In another form, the rim extends fully around a wearer's head with the headwear piece in the operative position on the wearer's head.

In one form, at least one of the elongate elements has a hollow construction.

In another form, at least one of the elongate elements has a core with a surrounding sleeve.

At least one of the elongate elements may be made from a single strand.

Alternatively, at least one of the elongate elements may be defined by a plurality of interconnected strands.

In one form, the rope has an effective diameter on the order of at least ¼ inch.

In another form, this diameter may be at least ½ inch.

In a still further form, this diameter may be at least ¾ inch.

In one form, the surrounding sleeve is made from a cloth layer that is formed into a hollow tube.

The invention is further directed to a headwear piece having a crown defining a surface for engaging a wearer's head so as to maintain the headwear piece in an operative position on the wearer's head, and a rim projecting away from the crown. The crown surface has a variable effective diameter. The crown includes a rope that can be selectively changed between (a) a first state wherein the rope has a first effective length and (b) a second state wherein the rope is elastically extended from the first effective length to a second effective length. The rope at least one of (a) defines at least a part of the crown surface and (b) bears against a wall that defines at least a part of the crown surface. The effective diameter of the crown surface is greater with the rope in the second state than with the rope in the first state.

The rope may include a plurality of interconnected, elongate elements.

In one form, the crown surface extends continuously through 360° around an opening to receive a wearer's head.

In one form, the crown has an open top through which a wearer's head projects with the headwear piece in the operative position on the wearer's head.

The crown may have an inverted cup-shaped configuration.

In one form, the rim extends only partially around a wearer's head with the headwear piece in the operative position on the wearer's head.

Alternatively, the rim extends fully around a wearer's head with the headwear piece in the operative position on the wearer's head.

The headwear piece may have an identification thereon associated with a person, place, or thing with which first and second colors are commonly associated. In one form, one of the elongate elements includes the first color and another of the elongate elements includes the second color.

The rope may be made up of at least four interconnected, elongate elements.

In one form, the rope has first and second elongate elements with different appearances that are interconnected to produce a pattern in which the first and second different appearances are exposed.

The first and second different appearances may be colors associated with a person, place, or thing.

In one form, the rope has an effective diameter on the order of at least ¾ inch.

In one form, the rope includes an elastic material.

BRIEF DESCRIPTION OF THE DRAWINGS

FIG. 1 is a perspective view of one form of headwear piece, in the form of a baseball-style cap, incorporating an extensible rope, according to the present invention;

FIG. 2 is a bottom view of the headwear piece in FIG. 1;

FIG. 3 is a rear elevation view of the headwear piece in FIGS. 1 and 2;

FIG. 4 is an enlarged, fragmentary, elevation view of the rope on the headwear piece in FIGS. 1-3, and consisting of a plurality of twisted, elongate elements;

FIG. 5 is an enlarged, elevation view of one of the elongate elements in FIG. 4 in a straight/linear shape;

FIG. 6 is a view corresponding to that in FIG. 5 with the elongate element twisted towards a spiral shape;

FIG. 7 is a view as in FIG. 4 of a modified form of rope, wherein the elongate elements are braided;

FIG. 8 is an enlarged, fragmentary, perspective view of one form of elongate element that can be incorporated into the inventive rope, and consisting of interconnected filaments;

FIG. 9 is a view as in FIG. 8 of another form of elongate element wherein the filaments are bundled;

FIG. 10 is a view as in FIGS. 8 and 9 of another form of elongate element wherein the elongate element is made from a single strand;

FIG. 11 is an enlarged, cross-sectional view of another form of elongate element consisting of a hollow tube of elastic material;

FIG. 12 is a view as in FIG. 11 wherein the material is a cloth or fibrous material;

FIG. 13 is a fragmentary, perspective view of a cloth layer used to form an elongate element, according to the prevent invention;

FIG. 23 is a view as in FIG. 1 of a further modified form of headwear piece wherein a rope extends fully around a crown having an associated rim extending only partially around a crown;

FIG. 24 is a perspective view of a further modified form of headwear piece, including a crown without a rim/bill, and having a rope extending fully around the crown;

FIG. 25 is a cross-sectional view of the headwear piece taken along line 25-25 of FIG. 24;

FIG. 26 is a view, as in FIG. 21, of a further modified form of headwear piece, wherein the crown is made substantially entirely from a rope and has a forwardly projecting rim/bill;

DETAILED DESCRIPTION OF THE DRAWINGS

Figure 14:
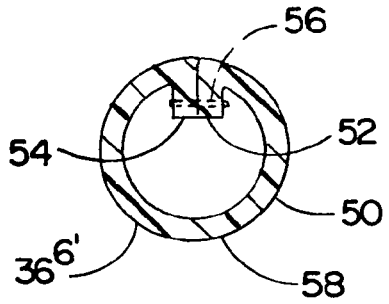
FIG. 14 is an enlarged, cross-sectional view of another form of elongate element made by forming the cloth layer in FIG. 13 into a tubular form.

Referring initially to FIGS. 1-3, one form of headwear piece, according to the present invention, is shown at 10. The headwear piece 10 is configured as a baseball-style cap that includes a crown 12 and a bill/rim 14 projecting angularly away from the front region of the crown 12 at 16. The crown 12 has an inside surface 18 bounding an opening at 20 for receiving a wearer's head with the headwear piece 10 in an operative position thereon.

The crown 12, shown in FIG. 1, is defined by a plurality of triangularly-shaped gores 22, which are placed edge-to-edge and joined by lines of stitching 24 to produce an inverted cup shape. The gores 22 can be folded under at the bottom edge 26 of the crown 12 so as to define the inside surface 18. An optional sweatband (not shown) can be applied on the inside of the crown to define the head-engaging surface 18.

The crown 12 has a cutout 28 at the rear thereof. The cutout 28 permits side edges 30,32, bounding the cutout 28, to be moved towards each other to thereby reduce the effective diameter of the opening 20 defined by the surface 18.

As seen most clearly in FIGS. 2 and 3, the invention contemplates the use of a rope 34, with an extendable length, to connect between the edges 30,32. By producing a tensile force on the rope 34, as results from the direction of a user's head into the opening 20, the length of the rope 34 is increased, thereby increasing the effective diameter for the opening 20.

The rope 34, according to the present invention, can take myriad different forms. As shown in FIG. 4, the rope 34 is made from a plurality of, and in this case three, elongate elements 36,38,40. In this embodiment, the elongate elements 36,38,40 are twisted against and relative to each other about their lengths.

As seen in FIGS. 5 & 6, for the exemplary elongate element 36, twisting of the elongate element 36 reduces the length of the elongate element 36 from its actual length L, which is the length the elongate element 36 has drawn to a straight/linear shape, to an effective length L1. Thus, by reason of this twisting, there is inherently built in a lengthwise extensibility of the elongate element 36 from its orientation in FIG. 6 to its straight orientation in FIG. 5. Thus, by exerting a lengthwise, tensile force on the rope 34 in the state in FIG. 6, the effective length of the elongate element 36 can be changed form the length L1 to the length L.

The interconnected elongate elements 36,38,40 interact with each other to maintain the generally spiral shape of the elongate element 36 and provide a resistance to elongation of the elongate element 36, that is predeterminable based upon the nature of the elongate elements 36,38,40 and the nature and tightness of the twisting. Thus, there is built into the rope 34 a degree of lengthwise elasticity without requiring any significant lengthwise elasticity for any of the individual elongate elements 34,36,38.

As shown in FIG. 7, a modified form of rope 34' may be made using the elongate elements 36,38,40 and interconnecting the elongate elements 36,38,40 by braiding the same.

The nature of the elongate elements 36,38,40 may vary over a wide range, in terms of both materials and construction. For purposes of this description, the elongate elements 36,38 are intended to be generic in nature, to incorporate all different variations set out herein.

As one example, the exemplary elongate element 36', as shown in FIG. 8, consists of a strand defined by a plurality of strategically interconnected filaments 42. The filaments 42 are preferably interconnected in such a manner as to allow a certain amount of lengthwise extensibility for the elongate element 36'. The interconnection may be through weaving, twisting, etc.

In FIG. 9, an elongate element 36" is defined by individual filaments 42' that are extended generally in a parallel direction aligned with the length of the elongate element 36". The filaments 42' are bundled so that there is but a modicum of lengthwise extensibility inherent to the combined filaments 42', that is less than that afforded by the interconnected filaments 42 defining the elongate element 36'.

In FIG. 10, an elongate element 36''' is shown as a single strand or filament 42'''. The strand/filament 42''' may be relatively inextensible in a lengthwise direction or may be significantly elastic to allow a significant degree of lengthwise extensibility, as indicated by the double-headed arrow 44.

As shown in FIG. 11, a modified form of elongate element $\mathbf{36}^{4x'}$ may be made as a hollow tube 46, as from rubber or the like, which affords substantial lengthwise extensibility.

A further modified form of elongate element is shown at $\mathbf{36}^{5x'}$ in FIG. 12. The elongate element $\mathbf{36}^{5x'}$ consists of a tubular body 48 that is made from interconnected filaments $\mathbf{42}^{5x'}$ that may be woven, bundled, etc.

In FIGS. 13 and 14, a further modified form of elongate element is shown at $\mathbf{36}^{6x'}$ and consists of a cloth layer 50 that has ends 52,54 doubled over and sewn by a line of stitching 56, to be in the form of an endless tube 58.

Figure 15:
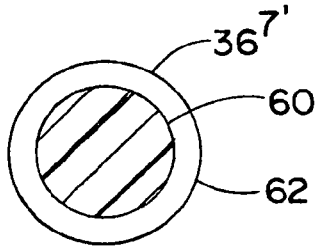
FIG. 15 is an enlarged, cross-sectional view of a further modified form of elongate element, including a core layer with a surrounding sleeve.

In FIG. 15, an elongate element $\mathbf{36}^{7x'}$ is shown with a core 60 and a surrounding sleeve 62. The core 60 may be made from an extensible material, such as rubber, with the sleeve 62 made from another material, such as cloth, or the like.

The various elongate elements 36-36$^{7x'}$ are just exemplary of those contemplated by the invention. The elongate elements 36-36$^{7x'}$, described above, can be incorporated into a rope form in different combinations using the basic concepts described herein. Some basic variations of the inventive rope will now be described, which again are not intended to be exhaustive of those contemplated by the invention.

Figure 16:
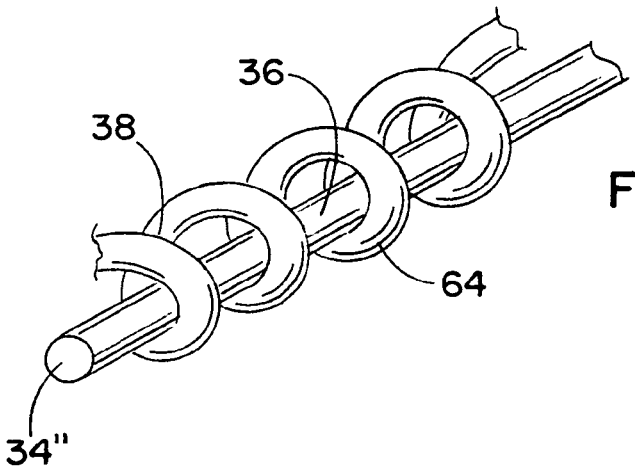
FIG. 16 is an enlarged, fragmentary, perspective view of a modified form of rope, according to the present invention, including an elongate element in a straight/linear shape and having another elongate element wrapped thereagainst.

As shown in FIG. 16, a modified form of rope 34" is shown with a core elongate element 36, in a straight/linear shape, about which a separate elongate element 38 is wrapped in a spiral pattern. The elongate element 38 is not required to be significantly extensible in a lengthwise direction and can be effectively elongated by widening the space between the individual coils 64, i.e., by changing the elongate element 38 toward a straight/linear shape. The core element 36 may, however, be more extensible in a lengthwise direction, as by being made from rubber, or the like.

Figure 17:
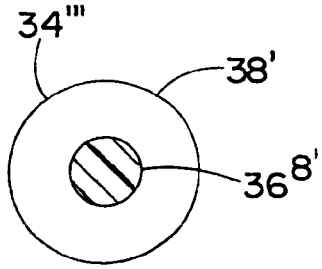
FIG. 17 is an enlarged, cross-sectional view of a further modified form of rope having a central, elastic core and a surrounding sleeve.

In FIG. 17, a modified form of rope 34''' is shown with an elongate element $\mathbf{36}^{8x'}$ defining a core that is surrounded by an elongate element 38', in the form of a hollow tube. The elongate element $\mathbf{36}^{8x'}$ may be made from rubber, or the like, with the elongate element 38' made from cloth, or a different type of rubber.

Figure 18:
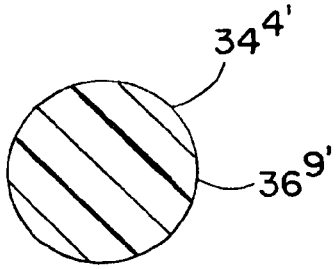
FIG. 18 is a view as in FIG. 17 of a further modified form of rope including a single, elastic element.

In its simplest state, the core may consist of a single element, though this construction is not preferred. As shown in FIG. 18, a rope $\mathbf{34}^{4x'}$ is shown with an elongate element $\mathbf{36}^{9x'}$ that is made from an extensible material, such as rubber.

Figure 19:
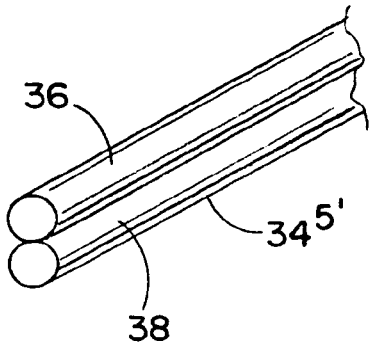
FIG. 19 is a view as in FIG. 16 of a further modified form of rope including two joined, elongate elements, each in a straight/linear shape.

In FIG. 19, a further modified form of rope is shown at $\mathbf{34}^{5x'}$, consisting of elongate elements 36,38, which are joined/interconnected without being wrapped around each other.

Figure 20:
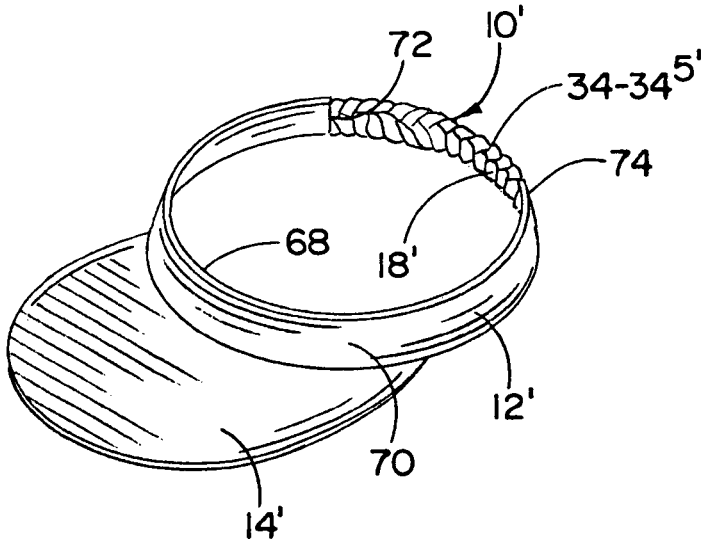
FIG. 20 is a view as in FIG. 1 of a modified form of headwear piece, according to the present invention, in the form of a visor with a rope extending partially around a crown thereon.

It is contemplated that the inventive ropes $\mathbf{34\text{-}34}^{5x'}$ could be integrated in different manners into different types of headwear constructions. In FIG. 20, a modified form of headwear piece is shown at 10' in the form of a visor with a crown 12', having a forwardly projecting bill/rim 14'. The crown 12' defines an inside surface 18' which frictionally grips the wearer's head. The crown 12' has an opening 68 therethrough at which the user's head is exposed with the headwear piece 10' in an operative position on the wearer's head.

The crown 12' has a forward portion at 70, which defines a part of the inside surface 18' and terminates at edges 72,74. The inventive rope $\mathbf{34\text{-}34}^{5x'}$ is connected between the edges 72,74, as by sewing, and defines the remainder of the inside surface 18'.

Figure 21:
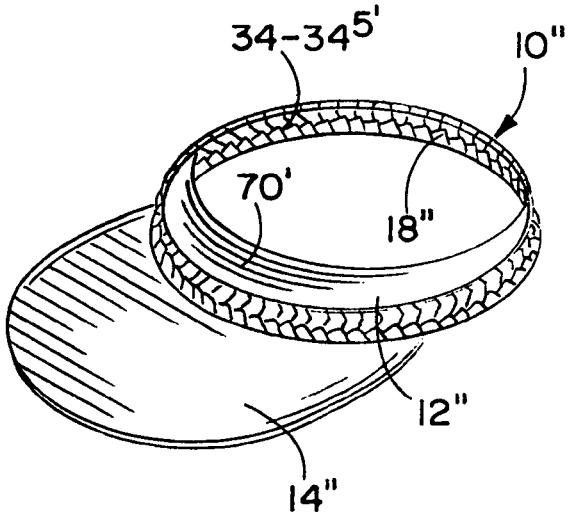
FIG. 21 is a view as in FIG. 20 of a modified form of visor wherein the rope extends fully around the crown.

In FIG. 21, a modified form of visor is shown at 10" with a crown 12" and a forwardly projecting bill/rim 14". The visor 10" differs from the visor 10' by reason of the fact that the rope $\mathbf{34\text{-}34}^{5x'}$ extends fully around the circumference of the crown, thus bearing a wall defining the surface 18" against a wearer's head over a part of the circumference thereof. Through this arrangement, the rope $\mathbf{34\text{-}34}^{5x'}$ is extensible throughout the circumference of the crown 12', with the exception of at any locations at which it may be fixedly connected to the forward portion 70'. In the headwear piece 10", the head-engaging surfaces 18" is defined partially by a wall at the forward portion 70' and partially by the rope $\mathbf{34\text{-}35}^{5x'}$.

Figure 22:
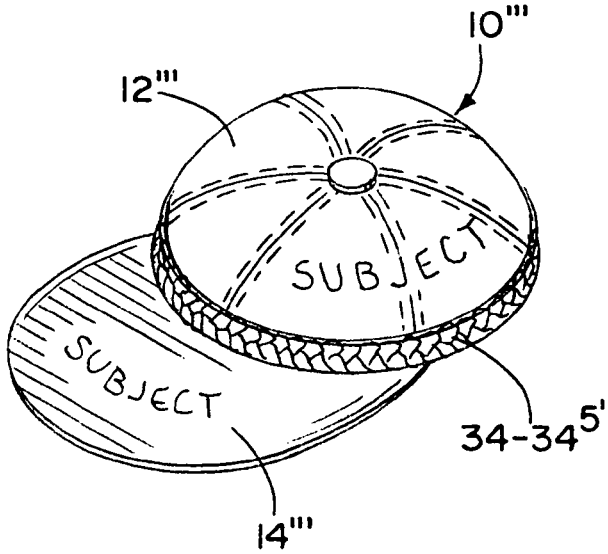
FIG. 22 is a view as in FIG. 1 of a baseball-style cap with a rope extending fully around a crown thereon.

In FIG. 22, a modified form of headwear piece is shown at 10''', having the same general construction as the headwear piece 10, to include a crown 12''' and a rim/bill 14'''. In this embodiment, as that shown in FIG. 21, the inventive rope $\mathbf{34\text{-}34}^{5x'}$ extends continuously around the crown 12'''. A rear cutout, corresponding to the cutout 28 in the headwear piece 10 in FIGS. 1-3, is optional.

In FIG. 23, a further modified form of headwear piece is shown at 10'''' with a crown $\mathbf{12}^{4x'}$ and rim $\mathbf{14}^{4x'}$ extending fully around the crown $\mathbf{12}^{4x'}$. In this embodiment, the inventive rope $\mathbf{34\text{-}34}^{5x'}$ is extended fully around the crown $\mathbf{12}^{4x'}$ at the lower region thereof.

In FIGS. 24 and 25, a further modified form of headwear piece is shown at $\mathbf{10}^{5x'}$ and consists of an inverted, cup-shaped crown $\mathbf{12}^{5x'}$ without any bill/rim. The inventive rope $\mathbf{34\text{-}34}^{5x'}$ is connected at the bottom of the crown $\mathbf{12}^{5x'}$ and extends fully therearound. In this embodiment, the rope $\mathbf{34\text{-}34}^{5x'}$ defines the entire inside surface $\mathbf{18}^{5x'}$ which engages the wearer's head with the headwear piece $\mathbf{10}^{5x'}$ in the operative position thereon.

A still further modified form of headwear piece, according to the present invention, is shown at $\mathbf{10}^{6x'}$ in FIG. 26. The headwear piece $\mathbf{10}^{6x'}$ has a crown $\mathbf{12}^{6x'}$ defined substantially entirely by the inventive rope $\mathbf{34\text{-}34}^{5x'}$. A rim/bill $\mathbf{14}^{5x'}$ projects forwardly from the crown $\mathbf{12}^{6x'}$. The rim/bill $\mathbf{14}^{5x'}$ could extend partially, or fully, around the crown $\mathbf{12}^{6x'}$.

Figure 27:
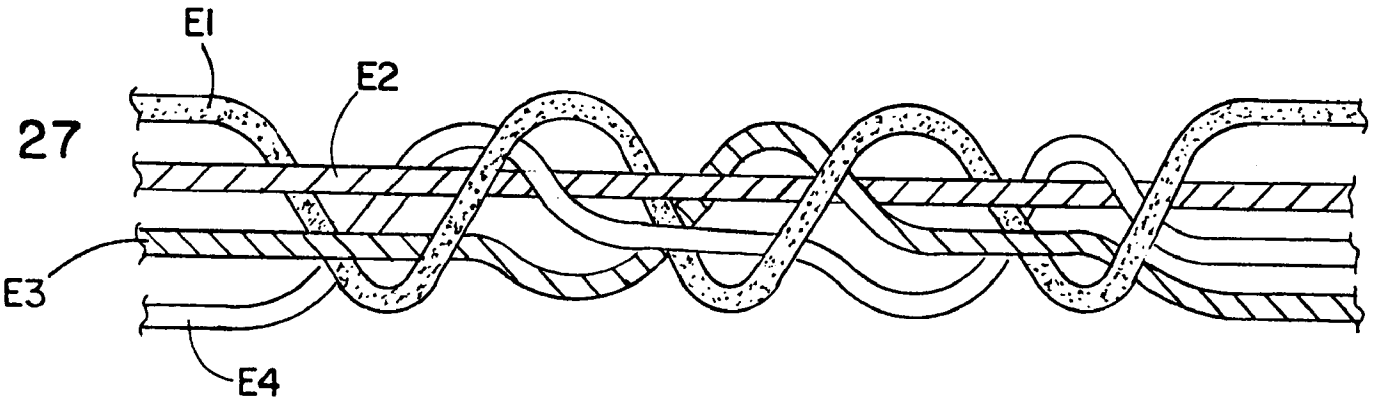
FIG. 27 is a view as in FIG. 7 wherein four elongate elements, with different appearances, are braided to define a rope.
Figure 28:
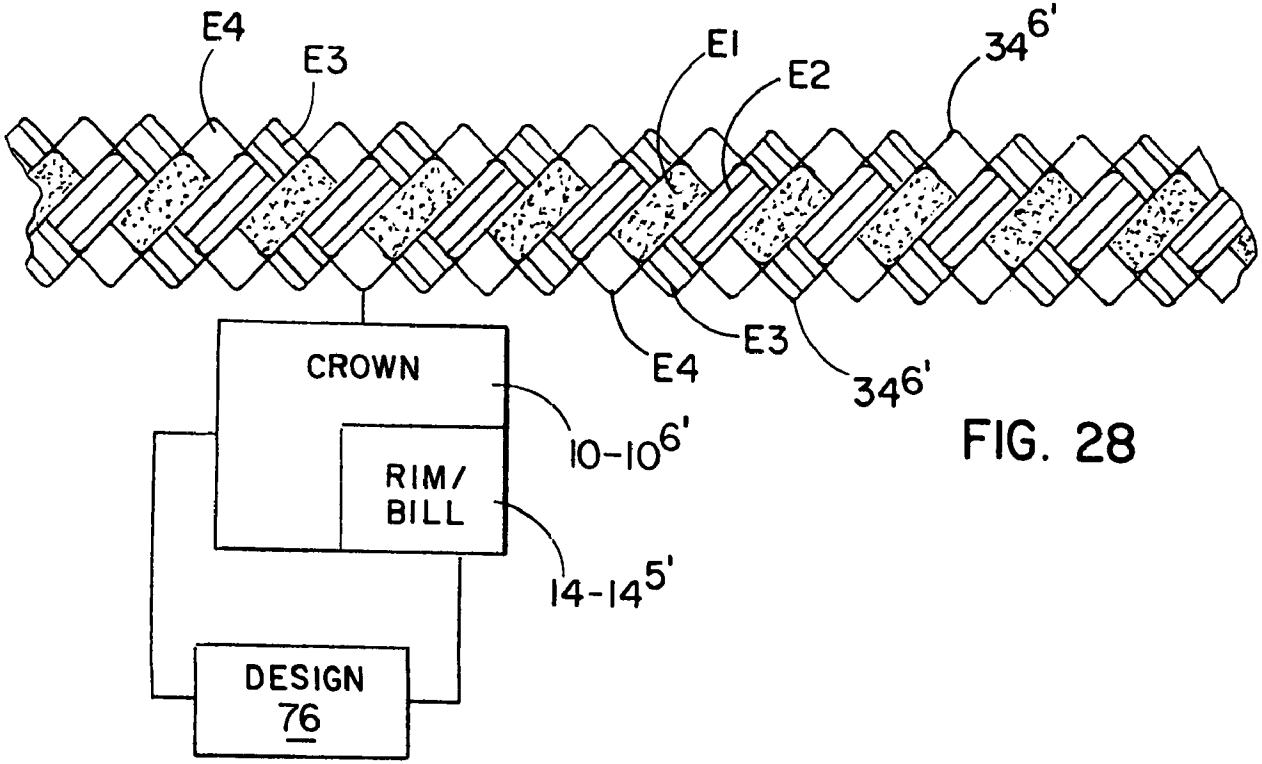
FIG. 28 is a view as in FIG. 27 wherein the rope is drawn taut.

In FIGS. 27 and 28, a further modified form of rope is shown at $\mathbf{36}^{6x'}$ consisting of four elongate elements E1, E2, E3, E4, each having any of the constructions for the elongate elements heretofore described, or another construction. The elongate elements E1, E2, E3, E4 are braided, as shown most clearly in FIG. 27, and drawn taut to the rope shape in FIG. 28. Preferably, at least two of the elongate elements have a different appearance, which may be attributable to a different pattern, texture, color, etc. As depicted, all of the elongate elements E1, E2, E3, E4 have different appearances.

The elongate elements are braided, as shown in FIG. 27, to produce a rope $\mathbf{34}^{6x'}$. By doing so, a regular pattern of the different appearances of the elongate elements E1-E4 is exposed, as shown in FIG. 28 for the completed rope $\mathbf{34}^{6x'}$. In this rope configuration, the repeating, exposed patterns of the elongate elements E3, E4 are eye-catching "diamond" shapes between which angled, rectangular or square shapes for the elongate elements E1, E2 alternatingly appear from a line extending horizontally and orthogonally to the length of the rope. The appearances of the elongate elements E1-E4 can be selected to produce an aesthetically pleasing, repeating diamond/rectangular/square pattern with selection of appearances and combinations thereof carried out to maximize visual effect. As just one example, the elongate elements E1, E2 may be made with two different colors that are associated with a team or school. The other elongate elements E3, E4 may be made with a neutral appearance or another shade of these same identifying colors.

Alternatively, at least two of the elongate elements E1-E4 may have different patterns thereon.

These colors/patterns can be coordinated with designs, shown generally at 76 in FIG. 28, associated with a person, place or thing identifiable by, or associated with, the colors/patterns used for the elongate elements E1-E4.

Figure 29:
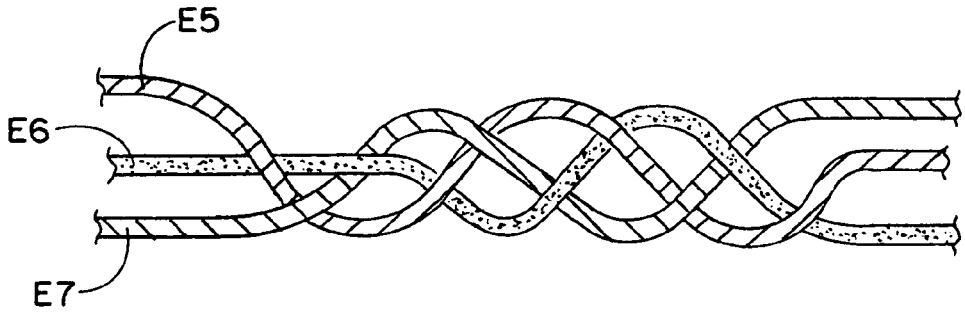
FIG. 29 is a view as in FIG. 27 wherein three elongate elements, with different appearances, are braided to define a rope.
Figure 30:
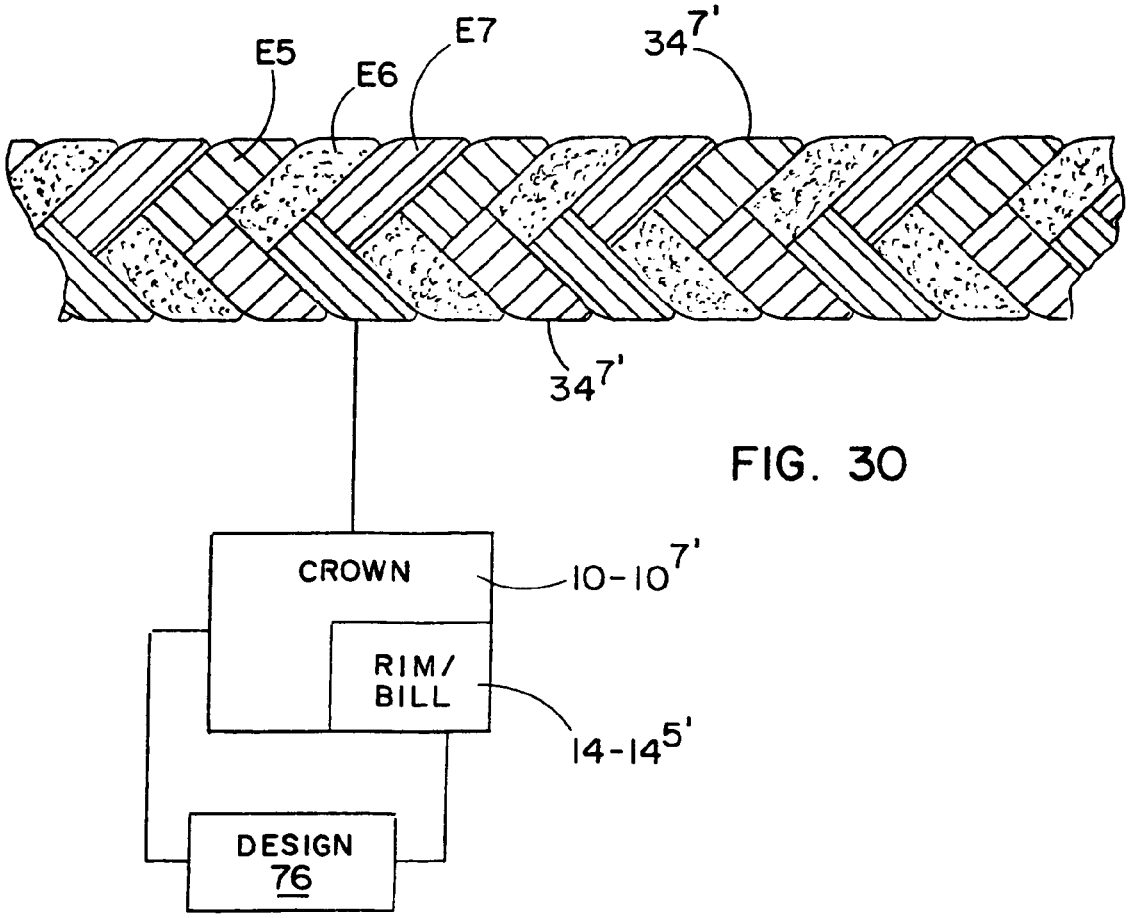
FIG. 30 is a view as in FIG. 27 wherein the rope is drawn taut.

In FIGS. 29 and 30, a rope $\mathbf{34}^{7x'}$ is depicted with three elongate elements E5, E6, E7, with at least two of the elongate elements E5, E6, E7 having different colors/patterns. The elongate elements E5, E6, E7 are braided, as seen most clearly in FIG. 29, and drawn taut to the FIG. 30 shape. The colors/patterns can be coordinated in a manner as described with respect to the rope $\mathbf{34}^{6x'}$ in FIGS. 27 and 28. The exposed appearances for each of the elongate elements E5, E6, E7 is a truncated rectangle.

Figure 31:
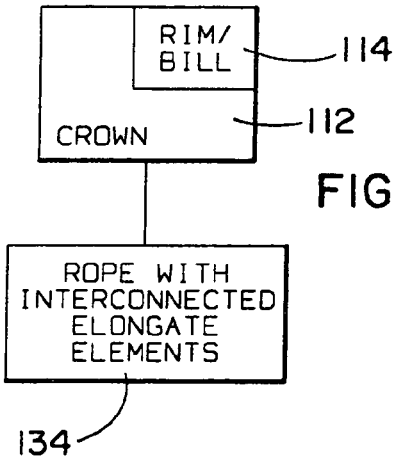
FIGS. 31-37 are schematic representations of headwear pieces with different forms of ropes, according to the present invention, incorporated therein.

The description hereinabove has been intended to identify representative embodiments of the invention. The invention is intended to encompass significantly more and different embodiments, which are shown in a generic/schematic form in FIGS. 31-37. As shown in FIG. 31, a generic form of headwear piece, having any construction including a crown 112 and rim/bill 114, or potentially without a rim/bill 114, is shown having a generic form of rope 134 defined by multiple elongate elements that are interconnected in virtually any manner, such that at least one of the elongate elements defining the rope 134 has an actual length and a reduced, effective length. For purposes of highly elastic material, the actual length is intended to be that length to which the elongate element is drawn before it nears its elastic limit. This interconnection may be by any means, among which are twisting, wrapping, sewing, gluing, weaving, wrapping, knitting, knotting, etc.

Figure 32:
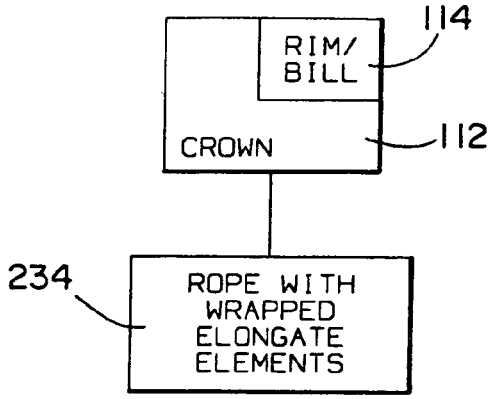
Figure 33:
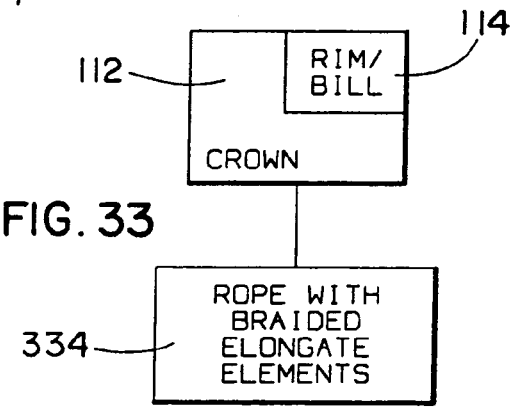

Within the universe of the structure shown in FIG. 31, the invention contemplates the aforementioned specific categories, as shown in FIGS. 32-37. As shown in FIG. 32, the generic rope 234 is defined by wrapped elongate elements associated with a crown 112 having a rim/bill 114. The wrapping involves at least two elongate elements and is not limited with respect to the total number of the elongate elements. All of the elongate elements may be wrapped, or one or more may be straight with an associated wrapped element.

FIG. 32 depicts generically a braided rope 334 associated with the crown 112 having the rim/bill 114. The braiding may range from a simple form to a complex form involving at least two, and virtually any larger number of, elongate elements, potentially with one or more of the elongate elements being substantially straight within the braided structure.

Figure 34:
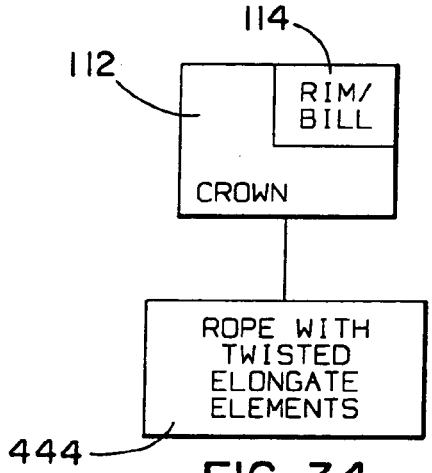

In FIG. 34, twisted ropes 444 are shown associated with the crown 112 having a rim/bill 114. Again, the twisting can be simple or complex in nature with potentially as few as one twisted and one untwisted elongate element, and different combinations thereof.

Figure 35:
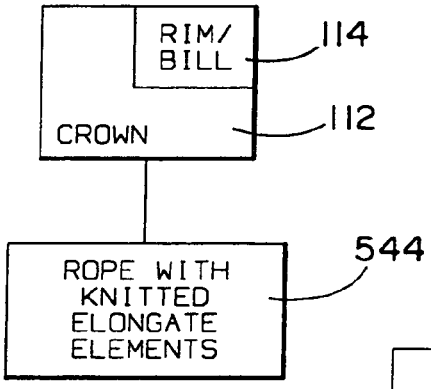
Figure 36:
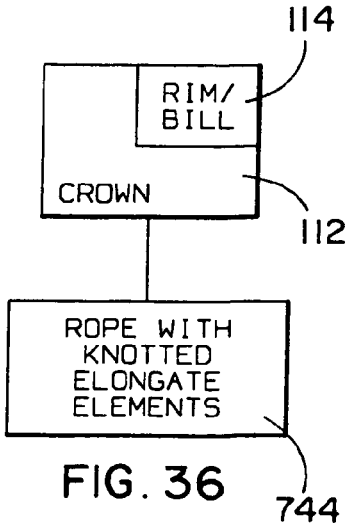

In FIGS. 35 and 36, ropes 544 and 644 are shown with respectively knitted and woven constructions in association with a crown 112 having a rim/bill 114. The weaving and knitting patterns may be any known to those in this industry.

Figure 37:
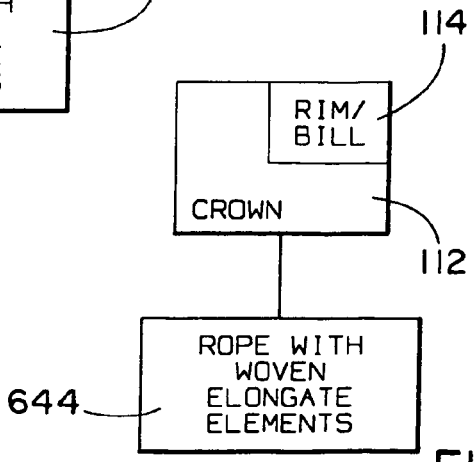

In a further variation, as shown in FIG. 37, a rope 744 may be strategically knotted and provided in association with the crown 112 having a bill/rim 114. The characterization "knotting" is intended to encompass any of a multitude of intermeshed elongate elements which produce different tying or knot patterns such that the length of the rope 744 can be extended by essentially elastic restricting or compacting of the "knots".

Through strategic interconnection of elongate elements, elasticity, with memory, is incorporated by reason of the interconnection of the elongate elements, without requiring elastic components. Elastic components may be incorporated to add another dimension to the extensibility of the ropes. At the same time, a unique aesthetic aspect is potentially incorporated due to the appearance of the ropes.

The diameter, or effective diameter D, for exemplary elongate element 40 as shown in FIG. 4, is preferably on the order of at least 1/16 of an inch, and may be larger, such as at least as large as 1/8 or 1/4 inch, or more. The invention further contemplates that the diameter D could be less than 1/16 inch.

The diameter D1 of the rope 34, as shown in FIG. 4, may be on the order of at least 1/4 inch, or in other forms at least 1/2 inch, 3/4 inch, or more. The invention contemplates that the rope 34 could have a diameter D1 less than 1/4 inch, although this is not preferred.

In those constructions where the rope 34 directly engages a substantial circumference of the user's head, it is desirable that a substantial vertical contact dimension be established. Preferably, the vertical contact zone would have a dimension D2 (FIG. 3) on the order of 1 inch or more, with the rope 34 tending to be flattened against the user's head with the headwear piece in the operative position, as seen, for example, in FIGS. 28 and 30, whereby the exposed elongate element E1-E7 have a flattened and widened appearance. Resultingly, the ropes $\mathbf{34}^{6x'}$, $\mathbf{34}^{7x'}$ likewise have an overall flat shape at the exposed, outwardly facing surfaces thereon defined by the multiple elongate elements E1-E7 that produce the contrasting and alternating shapes. As a result, external contours and appreciable gaps between the elongate elements E1-E7, as seen from a perspective as in FIG. 3 along a line generally orthogonal to the length of the rope, otherwise resulting from using more rigid elongate elements E1-E7, can be avoided so that the pattern produced by the elongate elements E1-E7 is more consistent and without shadows that may produce blurring at transitions between adjacent contrasting elongate elements E1-E7. Greater and lesser vertical contact dimensions are contemplated.

While the headwear piece 10 in FIG. 1 has been described with respect to the rope 34, it is contemplated that all variations of the rope 34-$\mathbf{34}^{7x'}$, and others not expressly described herein, could be used thereon.

In all designs for the rope 34-$\mathbf{34}^{7x'}$, as noted previously, and as shown particularly for the ropes $\mathbf{34}^{6x'}$, $\mathbf{34}^{7x'}$ using the braided elongate elements E1-E7 in FIGS. 27-30, a number of the elongate elements may remain visible. As a result, it is possible to exploit, for aesthetic purposes, the separately visible elongate elements, by using different colors, patterns, of color schemes, etc. thereon. Aside from the fact that the overall aesthetics of the headwear can be improved in this manner, the invention lends itself to integration of the ropes 34-$\mathbf{34}^{7x'}$ into a subject matter with which the headwear is associated. As further shown in one exemplary headwear piece 10''' in FIG. 22, the crown 12''' and or rim/bill 14''' may have information thereon, shown generically as "subject", relating to a person, place or thing. With this person, place or thing, one or more colors may be commonly associated. The individual elongate elements in the ropes 34-$\mathbf{34}^{7x'}$ may use one or a combination of these colors in the separate elongate elements to produce a unique coordinated effect with the "subject" on the crown 12'''.

Many variations, from the subject matter described above, are contemplated by the invention. For example, the elongate cords in a rope may have different diameters as well as different shapes, compositions, interconnecting shapes, etc.

While the invention has been described with particular reference to the drawings, it should be understood that various modifications could be made without departing from the spirit and scope of the present invention.

The invention claimed is:

1. A headwear piece comprising:

a crown defining a surface for engaging a wearer's head so as to maintain the headwear piece in an operative position on the wearer's head, the crown surface defining an opening having a variable effective diameter, the crown comprising a rope comprising a plurality of elongate elements each having an actual length and interconnected with each other with the rope in a first state so as to define an effective length extending around at least a portion of the crown, the plurality of elongate elements elastically maintained at the effective lengths at least partially by reason of their interconnection with each other and extendable towards their actual lengths by exerting a tensile lengthwise force on the rope to place the rope in a second state as an incident of a user's head being directed into the opening so as to thereby produce a tensile force on the rope whereby the headwear piece is in an operative position on a wearer's head, the rope at least one of (a) defining at least a part of the crown surface and (b) bearing against a wall that defines at least a part of the crown surface and having an exposed surface facing outwardly away from the crown surface, the effective diameter of the crown surface being greater with the rope in the second state than with the rope in the first state, the elongate elements flattened at the exposed surface of the rope with the rope in the second state so that there are no appreciable gaps between adjacent elongate elements at the exposed surface of the rope and so that there is a repeating pattern of at least one substantially identical shape viewable at the exposed surface of the rope over a substantial portion of the length of the rope, developed as an incident of the elongate rope being changed from the first state into the second state wherein at least one of the elongate elements has a hollow construction made from filaments that are one of: in the form of a cloth; woven; or bundled.

2. The headwear piece according to claim 1 wherein a rim projects away from the crown and the crown surface extends continuously through 360° around an opening to receive a wearer's head.

3. The headwear piece according to claim 1 wherein a rim projects away from the crown and at least one of the elongate elements comprises elastic material.

4. The headwear piece according to claim 1 wherein a rim projects away from the crown and the plurality of elongate elements each has a length and are interconnected by wrapping one of the elongate elements around another of the elongate elements with the lengths extending generally circumferentially around the crown surface.

5. The headwear piece according to claim 1 wherein a rim projects away from the crown and the plurality of elongate elements are interconnected by at least one of: twisting; braiding; weaving; knitting; and knotting.

6. The headwear piece according to claim 1 wherein a rim projects away from the crown and with the rope in the first state, at least one of the elongate elements has an effective diameter on the order of at least 1/16 inch.

7. The headwear piece according to claim 1 wherein a rim projects away from the crown and with the rope in the first state, at least one of the elongate elements has an effective diameter on the order of at least 1/8 inch.

8. The headwear piece according to claim 1 wherein a rim projects away from the crown and with the rope in the first state, at least one of the elongate elements has an effective diameter on the order of at least 1/4 inch.

9. The headwear piece according to claim 1 wherein a rim projects away from the crown and the headwear piece has an identification thereon associated with a person, place, or thing with which first and second colors are commonly associated, and one of the elongate elements includes the first color and another of the elongate elements includes the second color.

10. The headwear piece according to claim 1 wherein a rim projects away from the crown and the rope comprises at least four interconnected, elongate elements that produce repeating patterns at the exposed surface of the rope that are one of: diamonds; squares; and rectangles.

11. The headwear piece according to claim 10 wherein first and second of the elongate elements have different appearances and the first and second elongate elements produce adjacent arrangements of the one of the: diamonds; squares; and rectangles.

12. The headwear piece according to claim 11 wherein the different appearances are first and second different colors.

13. The headwear piece according to claim 12 wherein the first and second colors are associated with a person, place or thing and there is information on at least one of the crown and rim associated with the person, place, or thing.

14. The headwear piece according to claim 1 wherein a rim projects away from the crown and the rope comprises first and second elongate elements with different appearances and the first and second elongate elements are interconnected to produce a pattern in which the first and second different appearances are exposed.

15. The headwear piece according to claim 14 where the first and second different appearances comprise colors associated with a person, place, or thing.

16. The headwear piece according to claim 1 wherein a rim projects away from the crown and the crown has an open top through which a wearer's head projects with the headwear piece in the operative position on the wearer's head.

17. The headwear piece according to claim 1 wherein a rim projects away from the crown and the crown has an inverted cup-shaped configuration.

18. The headwear piece according to claim 1 wherein a rim projects away from the crown and the rim extends only partially around a wearer's head with the headwear piece in the operative position on the wearer's head.

19. The headwear piece according to claim 1 wherein a rim projects away from the crown and the rim extends fully around a wearer's head with the headwear piece in the operative position on the wearer's head.

20. The headwear piece according to claim 1 wherein a rim projects away from the crown and at least one of the elongate elements comprises a single strand.

21. The headwear piece according to claim 1 wherein a rim projects away from the crown and at least one of the elongate elements is defined by a plurality of interconnected strands.

22. The headwear piece according to claim 1 wherein a rim projects away from the crown and the rope has an effective diameter on the order of at least 1/4 inch.

23. The headwear piece according to claim 1 wherein a rim projects away from the crown and the rope has an effective diameter on the order of at least 1/2 inch.

24. The headwear piece according to claim 1 wherein a rim projects away from the crown and the rope has an effective diameter on the order of at least 3/4 inch.

25. A headwear piece comprising:

a crown defining a surface for engaging a wearer's head so as to maintain the headwear piece in an operative position on the wearer's head, the crown surface having a variable effective diameter, the crown comprising a rope comprising a plurality of elongate elements each having an actual length and interconnected with each other with the rope in a first state so as to define an effective length extending around at least a portion of the crown, the plurality of elongate elements elastically maintained at the effective lengths at least partially by reason of their interconnection with each other and extendable towards their actual lengths by exerting a tensile lengthwise force on the rope to place the rope in a second state resulting from placing the headwear piece in an operative position on a wearer's head, the rope at least one of(a) defining at least a part of the crown surface and (b) bearing against a wall that defines at least a part of the crown surface and having an exposed surface facing outwardly away from the crown surface, the effective diameter of the crown surface being greater with the rope in the second state than with the rope in the first state, wherein a rim projects away from the crown and at least one of the elongate elements has a hollow construction made from filaments that are one of: in the form of a cloth; woven; or bundled.

26. A headwear piece comprising:

a crown defining a surface for engaging a wearer's head so as to maintain the headwear piece in an operative position on the wearer's head, the crown surface having a variable effective diameter, the crown comprising a rope comprising a plurality of elongate elements each having an actual length and interconnected with each other with the rope in a first state so as to define an effective length extending around at least a portion of the crown, the plurality of elongate elements elastically maintained at the effective lengths at least partially by reason of their interconnection with each other and extendable towards their actual lengths by exerting a tensile lengthwise force on the rope to place the rope in a second state resulting from placing the headwear piece in an operative position on a wearer's head, the rope at least one of(a) defining at least a part of the crown surface and (b) bearing against a wall that defines at least a part of the crown surface and having an exposed surface facing outwardly away from the crown surface, the effective diameter of the crown surface being greater with the rope in the second state than with the rope in the first state, wherein a rim projects away from the crown and at least one of the elongate elements comprises a core with a surrounding sleeve.

27. The headwear piece according to claim 26 wherein the surrounding sleeve comprises a cloth layer that is formed into a hollow tube.

28. A headwear piece comprising:

a crown defining a surface for engaging a wearer's head so as to maintain the headwear piece in an operative position on the wearer's head, the crown surface having a variable effective diameter, the crown comprising a rope that can be selectively changed between (a) a first effective length and (b) a second state wherein the rope is elastically extended from the first effective length to a second effective length resulting from placing the headwear piece in an operative position on a wearer's head, the rope at least one of (a) defining at least a part of the crown surface and (b) bearing against a wall that defines at least a part of the crown surface and having an exposed surface facing outwardly away from the crown surface, the rope having a length extending generally horizontally with the headwear piece in the operative position on a wearer's head, the effective diameter of the crown surface being greater with the rope in the second state than with the rope in the first state, the rope comprising at least four interconnected, elongate elements having lengths that extend generally circumferentially around the crown and that cooperatively produce a repeating pattern at the exposed surface of the rope that is one of: diamonds; squares; and rectangles without visible gaps therebetween as viewed from a perspective along a line orthogonal to the length of the rope and extending substantially horizontally wherein at least one of the elongate elements has a hollow construction made from filaments that are one of: in the form of a cloth; woven; or bundled.

29. The headwear piece according to claim 28 wherein a rim projects away from the crown and the plurality of interconnected, elongate elements comprise at least first and second elongate elements that have a contrasting appearance.

30. The headwear piece according to claim 29 wherein the headwear piece has an identification thereon associated with a person, place, or thing with which first and second colors are commonly associated, and one of the elongate elements includes the first color and another of the elongate elements includes the second color.

31. The headwear piece according to claim 29 wherein the rope comprises at least four interconnected, elongate elements.

32. The headwear piece according to claim 29 wherein the first and second different appearances comprise first and second different colors associated with a person, place or thing.

33. The headwear piece according to claim 32 wherein there is information on the crown associated with the person, place, or thing.

34. The headwear piece according to claim 29 wherein the rope comprises an elastic material.

35. The headwear piece according to claim 28 wherein a rim projects away from the crown and the crown surface extends continuously through 360° around an opening to receive a wearer's head.

36. The headwear piece according to claim 28 wherein a rim projects away from the crown and the crown has an open top through which a wearer's head projects with the headwear piece in the operative position on the wearer's head.

37. The headwear piece according to claim 28 wherein a rim projects away from the crown and the crown has an inverted cup-shaped configuration.

38. The headwear piece according to claim 28 wherein a rim projects away from the crown and the rim extends only partially around a wearer's head with the headwear piece in the operative position on the wearer's head.

39. The headwear piece according to claim 28 wherein a rim projects away from the crown and the rim extends fully around a wearer's head with the headwear piece in the operative position on the wearer's head.

40. The headwear piece according to claim 28 wherein a rim projects away from the crown and the rope has an effective diameter on the order of at least ¾ inch.

41. The headwear piece according to claim 28 wherein the elongate elements are flattened at the exposed surface of the rope with the rope in the second state.

42. The headwear piece according to claim 41 wherein the elongate elements have lengths extending generally circumferentially around the crown surface.

* * * * *